United States Patent [19]

Fujimura et al.

[11] Patent Number: 4,594,985

[45] Date of Patent: Jun. 17, 1986

[54] METHOD AND APPARATUS OF LEARNING CONTROL FOR AIR/FUEL RATIO OF AN INTERNAL COMBUSTION ENGINE TO AVOID STICKING TO LEAN OR RICH SIDE OPERATION

[75] Inventors: Kazushiro Fujimura; Kazuyoshi Mizuno, both of Toyota, Japan

[73] Assignee: Toyota Jidosha Kabushiki Kaisha, Toyota, Japan

[21] Appl. No.: 687,339

[22] Filed: Dec. 28, 1984

[30] Foreign Application Priority Data

Dec. 29, 1983 [JP] Japan ..... 58-247678

[51] Int. Cl.[4] ..... F02M 7/16

[52] U.S. Cl. ..... 123/489

[58] Field of Search ..... 123/440, 479, 489

[56] References Cited

U.S. PATENT DOCUMENTS 4,445,481 5/1984 Aoki et al. ..... 123/440

4,467,770 8/1984 Arimura et al. ..... 123/489

4,517,949 8/1984 Ito et al. ..... 123/489

*Primary Examiner*—Tony M. Argenbright

*Attorney, Agent, or Firm*—Cushman, Darby & Cushman

[57] ABSTRACT

In the learning control apparatus and method for air/fuel ratio of an internal combustion engine operated with fuel injection of the type that the actual fuel injection time duration is modified according to the mean value of each two successive end values of the air/fuel ratio feedback complementing factor in the constantly increasing and constantly decreasing modes, the actual fuel injection time duration is further modified to be stepwise increased when the air/fuel ratio feedback complementing factor increases above a predetermined value during lean side operation of the engine, or to be stepwise decreased when the air/fuel ratio feedback complementing factor decreases below a predetermined value during rich side operation of the engine.

12 Claims, 8 Drawing Figures

METHOD AND APPARATUS OF LEARNING CONTROL FOR AIR/FUEL RATIO OF AN INTERNAL COMBUSTION ENGINE TO AVOID STICKING TO LEAN OR RICH SIDE OPERATION

BACKGROUND OF THE INVENTION

1. Field of The Invention

The present invention relates to the control of fuel injection in internal combustion engines, and more particularly to a method of learning control for air/fuel ratio of an internal combustion engine operated with fuel injection to maintain the air/fuel ratio at the stoichiometric value.

2. Description of the Prior Art

In an internal combustion engine equipped with a three way catalytic converter it is very important that the air/fuel ratio in the operation of the engine should be maintained exactly at the stoichiometric value. To meet with such a requirement, particularly in an internal combustion engine operated with fuel injection, it is known to control the fuel injection by the so-called learning control method. According to a known method of learning control for air/fuel ratio of an internal combustion engine operated with fuel injection the fuel injection is controlled to maintain the air/fuel ratio at the stoichiometric value according to a basic fuel injection time duration based upon engine load and engine revolution speed, an air/fuel ratio feedback complementing factor which is changed over between a constantly increasing mode which continues as long as the air/fuel ratio is on the lean side of the stoichiometric value and a constantly decreasing mode which continues as long as the air/fuel ratio is on the rich side of the stoichiometric value, and a learning control factor. The actual fuel injection time duration is obtained by multiplying said basic fuel injection time duration by said air/fuel ratio feedback complementing factor and by further modifying the product by said learning control factor, so as to increase the actual fuel injection time duration when said learning control factor increases or to decrease the actual fuel injection time duration when said learning control factor decreases.

The learning control factor is obtained by initially setting its value at a predetermined initial value, and then calculating a mean value of each two successive end values of said air/fuel ratio complementing factor in said constantly increasing and constantly decreasing modes, thereby increasing the current value of the learning control factor by a predetermined increment each time when said mean value is calculated to be larger than a predetermined first limit value, decreasing the current value of the learning control factor by a predetermined decrement each time when said mean value is calculated to be smaller than a predetermined second limit value which is smaller than said first limit value, and maintaining the current value of the learning control factor each time when said mean value is calculated to be between said first and second limit values. Such a progress of the air/fuel ratio feedback complementing factor is shown in FIG. 1 of the accompanying drawings in relation to the fluctuation of the air/fuel ratio to both sides of the stoichiometric value.

However, when for some reasons such as a malfunction of a part of the fuel injection control device the learning control factor has been reduced for a substantial amount when the engine is operating on the lean side of the stoichiometric condition, due to a substantial decrease of the amount of fuel injected into the engine, the engine continues to operate on the lean side of the stoichiometric value, and therefore the air/fuel ratio feedback complementing factor continues to increase, finally reaching its upper limit value and saturating as a constant value, so that the next expected end value of the air/fuel ratio feedback complementing factor in the constantly increasing mode is not obtained, whereby the operation of the engine is stuck everlastingly to the lease side of the stoichiometric condition. These performances of the air/fuel ratio, the air/fuel ratio feedback complementing factor, and the learning control factor are shown in FIG. 2 of the accompanying drawings.

The similar sticking of the engine operation to the rich side of the stoichiometric condition may also occur if the learning control factor increases so much due to a malfunction of the fuel injection control device when the engine is operating on the rich side of the stoichiometric condition that the air/fuel ratio feedback complementing factor decreases down to its lower limit before the actual fuel injection time duration is increased enough to change over the operation of the engine from the rich side to the lean side of the stoichiometric condition.

BRIEF SUMMARY OF THE INVENTION

It is therefore the primary object of the present invention to improve the learning control system for air/fuel ratio of an internal combustion engine operated with fuel injection of the type described above so as to avoid the everlasting sticking of engine operation to the lean side or the rich side of the stoichiometric condition due to such a malfunction of the fuel injection control device that substantially decreases or increases the learning control factor.

Another object of the present invention is to accomplish the abovementioned object by a minimum variation of the actual fuel injection time duration so that the performance of the engine is maintained as close to the stoichiometric operation as possible over the whole operation period thereof.

According to the present invention, these objects are accomplished by a method and apparatus of learning control for air/fuel ratio of an internal combustion engine operated with fuel injection to maintain the air/fuel ratio at the stoichiometric value. To basic fuel injection time duration is determined according to engine load and engine revolution speed. An air/fuel ratio feedback complementing factor is determined which changes over between a constantly increasing mode which continues as long as the air/fuel ratio is on the lean side of the stoichiometric value and a constantly decreasing mode which continues as long as the air/fuel ratio is on the rich side of the stoichiometric value. Also a learning control factor is determined. The basic fuel injection time duration is multiplied by the air/fuel ratio feedback complementing factor and further modified by the learning control factor so as to be increased when said learning control factor increases and vice versa to provide an actual fuel injection time duration. The learning control factor is obtained by initially setting the learning control factor at a predetermined initial value, calculating a mean value of each two successive end values of the air/fuel ratio feedback complementing factor in the constantly increasing and constantly decreasing modes thereof, increasing the current value of the learning control factor by a predetermined increment each time when the mean value is calculated to be larger than a predetermined first limit value, decreasing the current value of the learning control factor by a predetermined decrement each time when the mean value is calculated to be smaller than a predetermined second limit value which is smaller than the first limit value, and maintaining the current value of the learning control factor each time when the mean value is calculated to be between the first and second limit values. The current value of the learning control factor may be further increased by a predetermined increment stepwise when and only when the air/fuel ratio feedback complementing factor is larger than a predetermined relatively large limit value and/or further decreased by a predetermined decrement stepwise when and only when said air/fuel ratio feedback complementing factor is smaller than a predetermined relatively small limit value.

BRIEF DESCRIPTION OF THE DRAWINGS

The present invention will now be shown and described with reference to some preferred embodiments thereof, and with reference to the illustrative drawings. It should be clearly understood, however, that the description of the embodiments, and the drawings, are all of them given purely for the purpose of explanation and exemplification only, and are none of them intended to be limitative of the scope of the present invention. In the accompanying drawings.

DETAILED DESCRIPTION OF THE PREFERRED EMBODIMENTS

Figure 3:
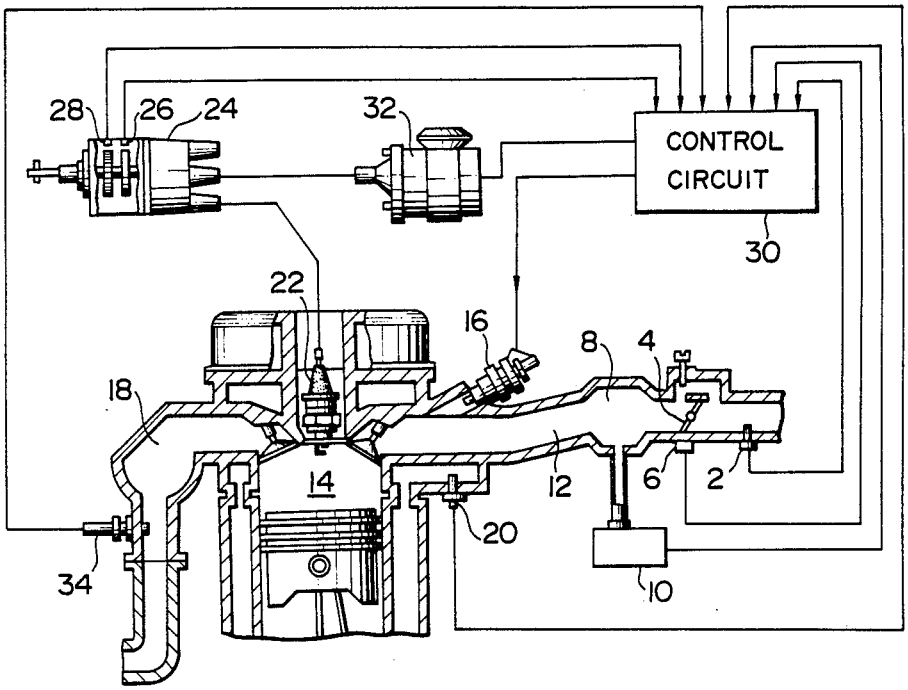
FIG. 3 is a diagrammatical illustration of a part of an internal combustion engine including the combustion chamber thereof and related intake and exhaust systems and a fuel injection control system related with the engine.

Referring to FIG. 3, here is shown a part of an internal combustion engine essential to the present invention, in which 14 is a combustion chamber of the engine which takes in intake air through an intake passage 12 including a throttle valve 4 and a surge tank 8. The temperature of the intake air which flows through the intake passage is measured by an intake air temperature sensor 2. The distinction of the engine operating condition between idling and load operations is made by a throttle switch 6, in cooperation with the measurement of the pressure of the intake air, which is performed by a pressure sensor 10 which is responsive to the pressure in the surge take 8. 16 is a fuel injection valve which injects fuel into the air flowing through the intake air passage 12 just before the air is introduced into the combustion chamber 14. 22 is an ignition plug which ignites the fuel-air mixture introduced into the combustion chamber 14 and compressed therein. The exhaust gas from the combustion chamber 14 is conducted through an exhaust passage 18. Oxygen, if it remains in the exhaust gases flowing through the exhaust passage 18, is detected by an oxygen sensor 34, whereby it is known whether the engine is operating on the lean side or the rich side of the stoichiometric condition. 20 is a temperature sensor which measures the temperature of the engine as the temperature of cooling water in the shown embodiment.

24 is a distributor which incorporates a cylinder sensor 26 which identifies each one of a plurality of cylinders and an engine revolution speed sensor 28. The distributor 24 receives a supply of a high voltage electric current from an ignition coil 32. The ignition coil 32 and the fuel injection valve 16 are under the control of a control circuit 30 which operates according to the information received from the intake air temperature sensor 2, the throttle sensor 6, the intake air pressure sensor 10, the engine temperature sensor 20, the oxygen sensor 34, the cylinder sensor 26 and engine revolution speed sensor 28.

Figure 4:
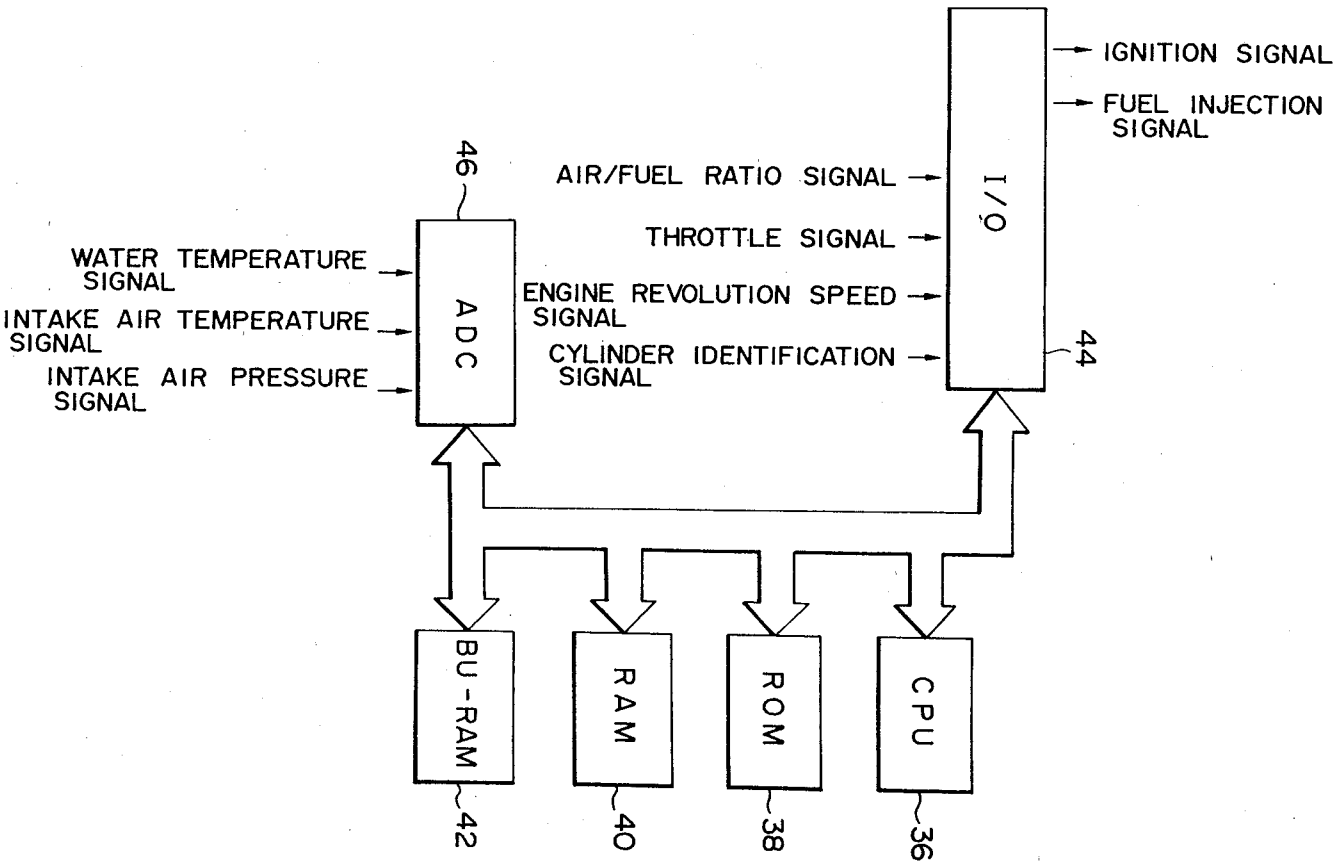
FIG. 4 is a diagram showing the data flow system in the fuel injection control system shown in FIG. 3.

The functional structure of the control circuit 30 is shown in FIG. 4. The control circuit 30 includes a central processing unit (CPU) 36, a read only memory (ROM) 38, a random access memory (RAM) 40, a back up random access memory (BU-RAM) 42, an input-/output (I/O) unit 44, and an analog-digital converter (ADC) 46. The input/output unit 44 receives input signals such as an air/fuel ratio signal, a throttle signal, an engine revolution speed signal, and a cylinder identification signal which are available from the sensing means as shown in FIG. 3. The analog-digital converter 46 receives other signals such as an engine cooling water temperature signal, an intake air temperature signal, and an intake air pressure signal which are also available from the sensing means shown in FIG. 3. The CPU 36, ROM 38, RAM 40, BU-RAM 42, I/O unit 44, and ADC 46 are connected with one another by bus means as shown in FIG. 4. According to the calculating operations as described hereinunder the I/O unit 44 dispatches a fuel injection signal which is a series of electric current signals each having a certain time duration. The I/O unit 44 also dispatches an ignition signal to operate the ignition plug 22.

In fuel injection control of the type described above with reference to FIGS. 1 and 2 the actual fuel injection time duration T is determined according to the following formula:

$$T=(Tb+Ti)\times KG\times FAF\times Fm$$

Wherein, Tb is the basic fuel injection time duration which is determined based upon engine load and engine revolution speed, Ti is the learning control factor which is adopted for idling operation of the engine as described hereinunder, KG is the learning control factor which is adopted for load operation of the engine as also described hereinunder, FAF is the air/fuel ratio feedback complementing factor, and Fm is a factor which is further to modify the actual fuel injection time duration according to intake air temperature, engine temperature, etc., as required.

When the engine is operating in idling condition the basic fuel injection time duration Tb is of a relatively small value. In such an operating condition it is more desirable that the modification of the basic fuel injection time duration by learning control is effected in a manner of changing the value of a factor such as Ti (changeable between plus and minus) added to the basic fuel injection time duration Tb. In this case, the learning control factor KG for load operation may be maintained at a constant value. By contrast, when the engine is operating in the loaded condition, it is more desirable that the modification of the basic fuel injection time duration by learning control is effected in a manner of changing the value of a factor such as KG multiplied to the air/fuel ratio feedback complementing factor FAF.

Figure 1:
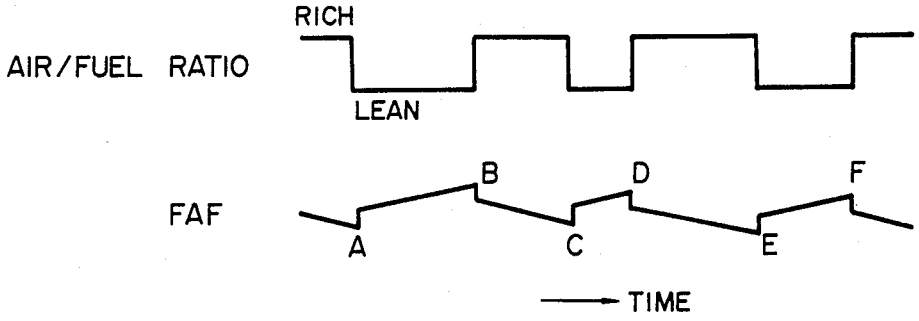
FIG. 1 is a diagram showing the performances of the engine operation by alternating changing over between the lean side and the rich side of the stoichiometric condition and of the corresponding air/fuel ratio feedback complementing factor.

The air/fuel ratio feedback complementing factor FAF is a control signal which is generally as shown in FIG. 1. This is changed over between a constantly increasing mode of a certain predetermined increasing ratio relative to time which continues as long as the air/fuel ratio, which is actually detected by the oxygen sensor 34, is on the lean side of the stoichiometric value and a constantly decreasing mode of a certain predetermined decreasing ratio relative to time which continues as long as the air/fuel ratio is on the rich side of the stoichiometric value.

The learning control factor KG is, when the fuel injection control system is put into operation, initially set to a predetermined initial value, and is thereafter controlled according to the mean value of each two successive end values such as A, B, C, D, E, F, . . . of the air/fuel ratio feedback complementing factor FAF in the constantly inreasing and constantly decreasing modes each time when the air/fuel ratio feedback complementing factor FAF is changed over between these two modes. When said mean value has been calculated to be larger than a predetermined first limit value such as, for example, 1.02, the learning control factor KG or Ti is increased by a predetermined increment such as dKG or dFi, respectively. By contrast, when said mean value has been calculated to be smaller than a predetermined second limit value such as, for example, 0.98, the learning control factor KG or Ti is decreased by a predetermined decrement such as dKG or dFi, respectively. When said mean values are between the first and second limit values, the learning control factor KG or Ti is maintained at its current value.

The selection for adoption between the learning control factors KG and Ti is effected according to the signal received from the throttle sensor 6. Further, the learning control factor KG in load operation may be classified into several groups of values according to the level of intake air pressure so that the value of learning control factor is varied according to whether the intake air pressure is, for example, in the range of 200–300 mmHg, 300–400 mmHg, or 400–500 mmCHg. Further, the system may be so adjusted that the learning control is performed only when the engine cooling water temperature is above a certain predetermined value, such as, for example, 70° C.

Figure 2:
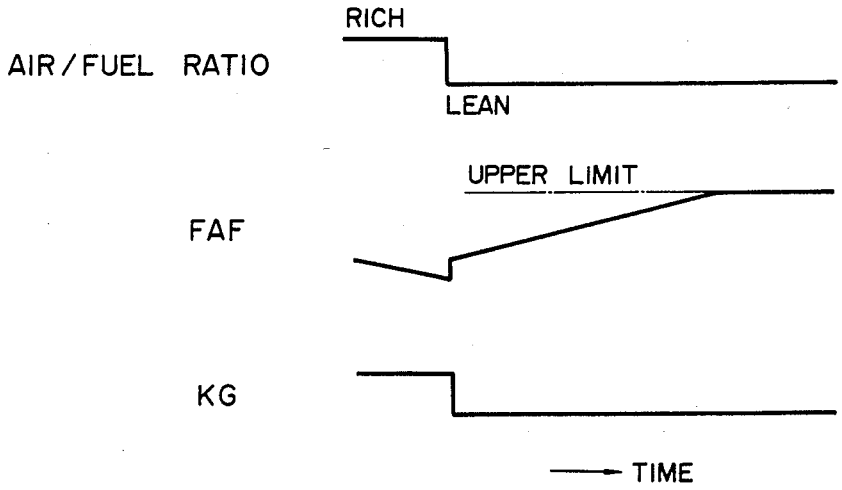
FIG. 2 is a diagram showing the performances of the engine operation and the air/fuel ratio feedback complementing factor as shown in FIG. 1 with an additional illustration of the performance of the learning control factor which has suddenly substantially decreased due to a malfunction of the fuel injection control device.

As already described, in this kind of fuel injection control, if the learning control factor, particularly the learning control factor KG for load operation of the engine substantially decreases for some reasons such as a malfunction of the control system, as shown in FIG. 2, when the engine is operating on the lean side of the stoichiometric condition, the air/fuel ratio feedback complementing factor FAF might increase so far as to reach its upper limit before the actual fuel injection time duration is increased enough to change over the operating condition of the engine from the lean side to the rich side of the stoichiometric condition. If this once occurs, since the next expected end value of the air/fuel ratio feedback complementing factor FAF in the constantly increasing mode is not obtained, the mean value of the last two successive end values appears to be substantially decreased, and therefore the learning control factor KG is further reduced, thereby further biasing the operating condition of the engine toward the lean side. Thus, the operating condition of the engine would stick to the lean side operation.

Figure 5:
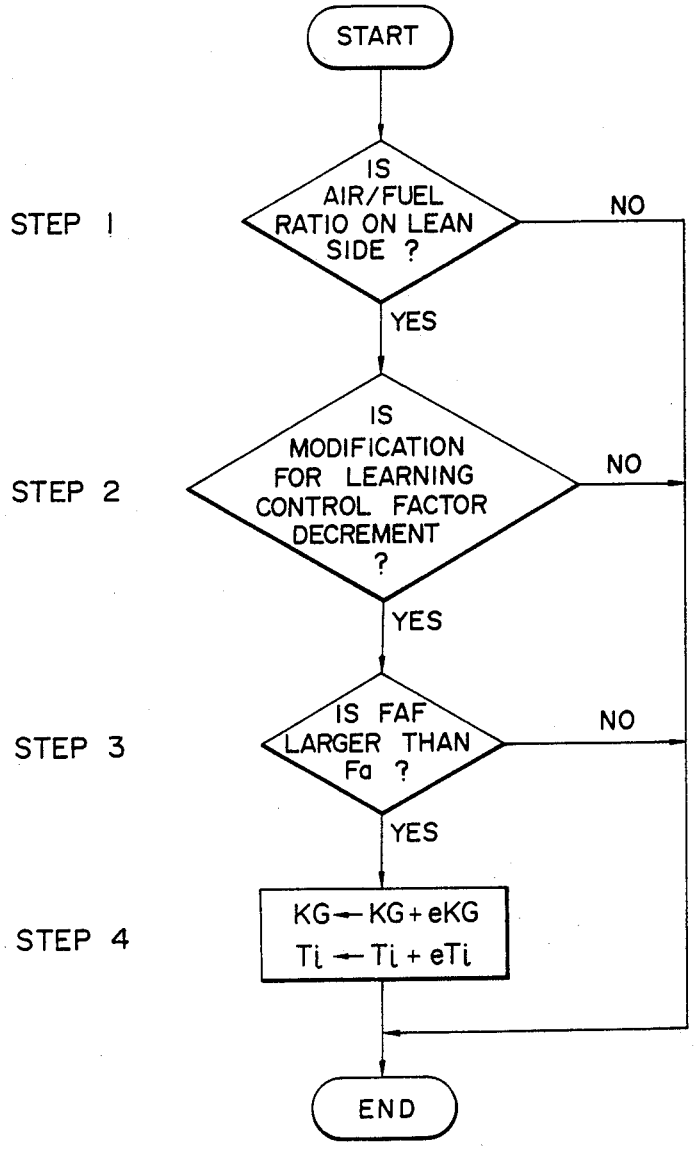
FIG. 5 is a flow chart showing an embodiment of the method of learning control for air/fuel ratio of an internal combustion engine operated with fuel injection according to the present invention.

Now, referring to FIG. 5, the essential process in the method according to the present invention is shown in the form of a flow chart. When this process was started, first in step 1 the signal from the oxygen sensor 34 is checked to determine whether the air/fuel ratio is on the lean side of the stoichiometric value or not. If the answer is yes, the process proceeds to step 2. If the answer is no, the process proceeds toward END. In step 2, it is checked whether the modification amount for the learning control factor KG or Ti is a decrement or not. If the answer is yes, the process proceeds to step 3. If the answer is no, the step proceeds toward END. In step 3, it is checked whether the air/fuel ratio feedback complementing factor FAF is larger than a predetermined upper set value Fa. If the answer is yes, the process proceeds toward step 4, and the learning control factor KG is increased by an increment eKG when the engine is in load operation, or the learning control factor Ti is increased by an increment eTi when the engine is in idling operation. If the answer in step 3 is no, the process proceeds toward END.

Figure 6:
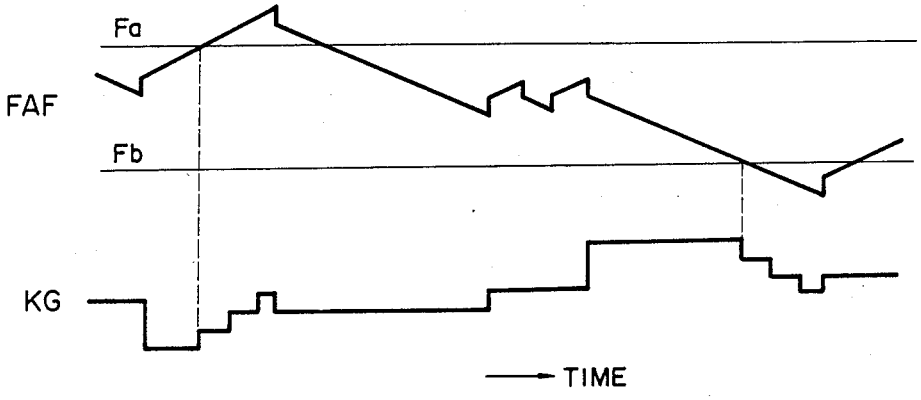
FIG. 6 is a diagram showing the performances of the air/fuel ratio feedback complementing factor and the learning control factor effected by the method as shown in FIG. 5.

In FIG. 6, in its left side portion, it is shown how the learning control factor KG or Ti is increased stepwise by the increment eKG or eTi according to the process through steps 1, 2, 3 and 4 in FIG. 5 until the actual fuel injection time duration is increased enough to cause the changing over of the engine operating condition from the lean side to the rich side of the stoichiometric condition, so that now the learning control is resumed to the operation based upon the mean value of two successive end value of the air/fuel ratio feedback complementing factor which controls the increment or the decrement by dKG or dTi for the modification of the learning control factor KG or Ti.

Figure 7:
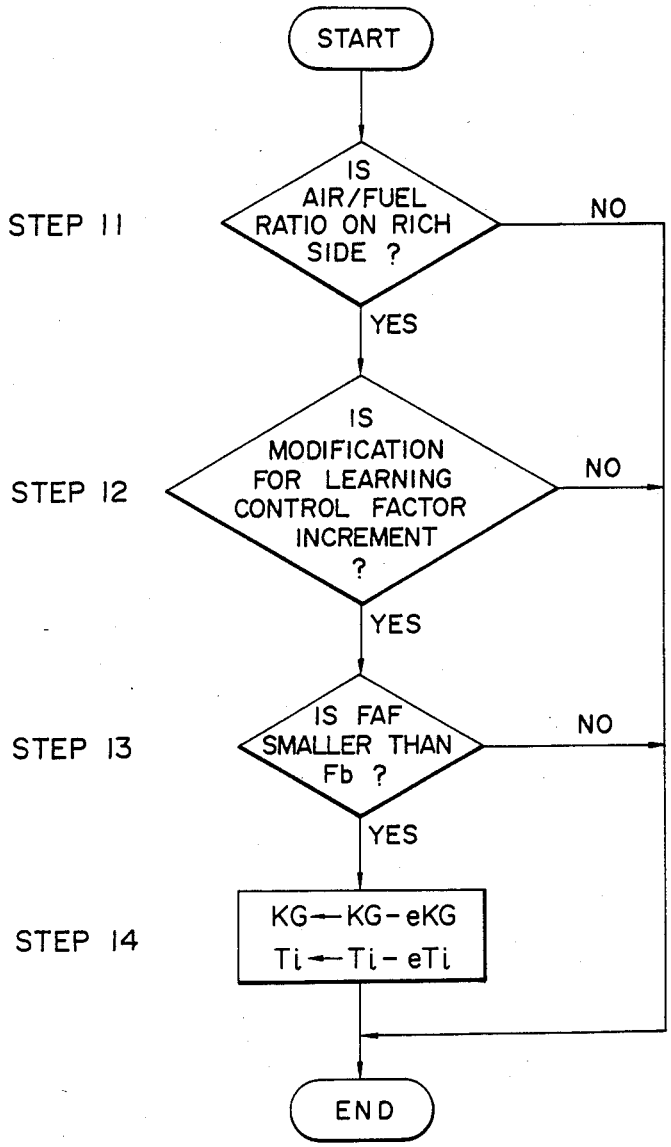
FIG. 7 is a flow chart similar to FIG. 5 showing another embodiment of the method of learning control for air/fuel ratio of an internal combustion engine with fuel injection according to the present invention.

FIG. 7 is a flow chart similar to FIG. 5, showing another embodiment of the present invention. When the process has been started, first, in step 11, according to the signal from the oxygen sensor 35 it is checked to know whether the air/fuel ratio is on the rich side of the stoichiometric value or not. If the answer is yes, the process proceeds toward step 12. If the answer is no, the process toward END. In step 12, it is checked whether the modification amount for the learning control factor KG or Ti is an increment or not. If the answer is yes, the process proceeds toward step 13. If the answer is no, the process proceeds toward END. In step 13, it is checked whether the air/fuel ratio feedback complementing factor FAF is smaller than a predetermined lower limit value Fb. If the answer is yes, the process proceeds toward step 14, wherein the learning control factor KG is decreased by an amount eKG when the engine is in load operation or the learning control factor Ti is decreased by an amount eTi when the engine is in idling operation. This process through steps 11, 12, 13, and 14 is shown in the right side portion of FIG. 6, wherein the learning control factor is stepwise decreased by the amount of eKG or eTi until the actual fuel injection time duration is decreased enough to cause the changing over of the engine operating condition from the rich side to the lean side of the stoichiometric condition, whereby the learning control is resumed to the operation based upon the mean value of the two successive end values of the air/fuel ratio feedback complementing factor.

Figure 8:
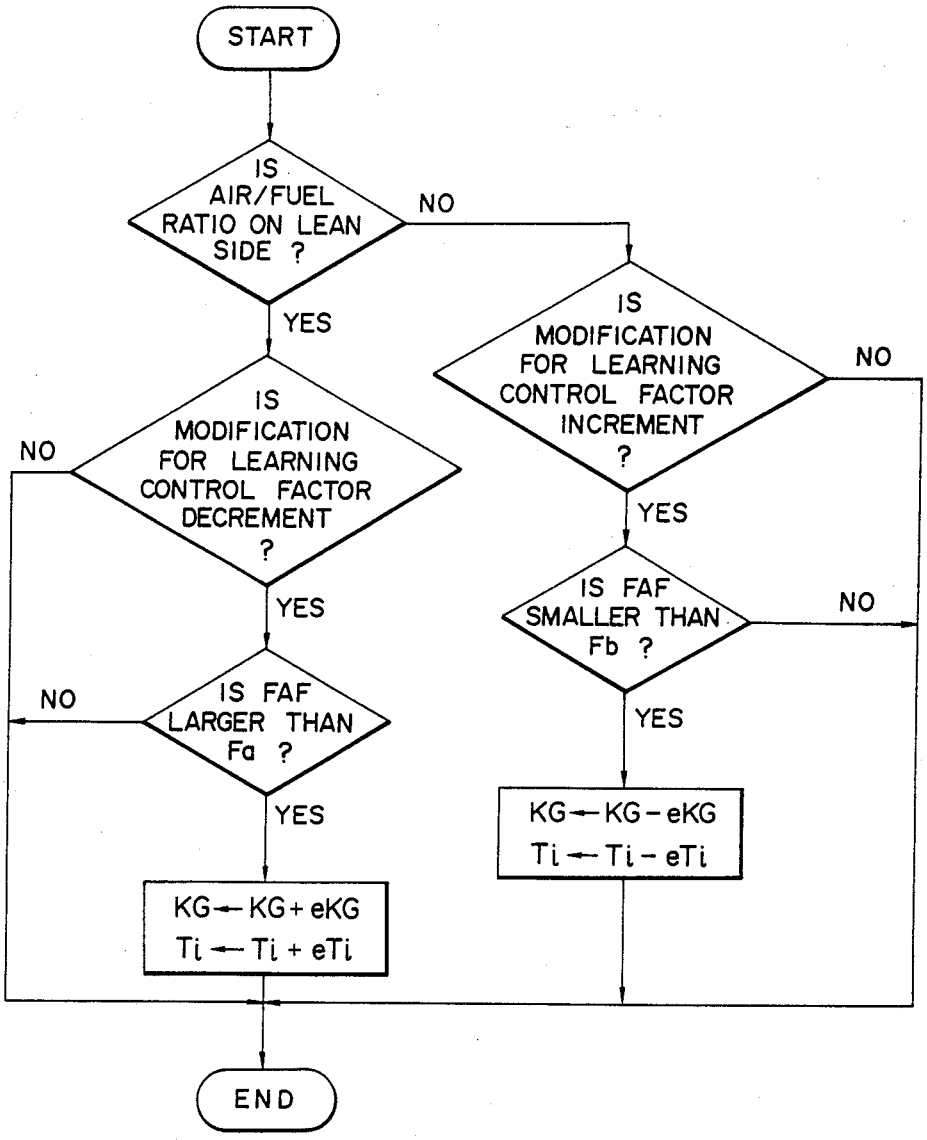
FIG. 8 is a flow chart similar to FIGS. 5 and 7 showing still another embodiment of the method of learning control for air/fuel ratio of an internal combustion engine with fuel injection according to the present invention.

FIG. 8 shows still another embodiment of the present invention, in which the embodiments shown in FIGS. 5 and 7 are combined to provide a more improved learning control system for air/fuel ratio of an internal combustion engine operated with fuel injection to maintain the air/fuel ratio at the stoichiometric value. Since the operation of this embodiment according to the flow chart shown in FIG. 8 will be understandable to one of ordinary skill in the relevant art without undue experimentation, in view of the discussion presented above with regard to FIGS. 5 and 7, the detailed explanation thereof will be herein omitted in view of desirability of brevity of description.

Although the invention has been shown and described with reference to some preferred embodiments thereof, and in terms of the illustrative drawings, it should not be considered as limited thereby. Various possible modifications, omissions, and alterations could be conceived of by man skilled in the art to the form and the content of the shown embodiments, without departing from the scope of the present invention.

What is claimed is:

1. A method of learning control for air/fuel ratio of an internal combustion engine operated with fuel injection to maintain the air/fuel ratio at the stoichiometric value, comprising the steps of:

determining a basic fuel injection time duration according to engine load and engine revolution speed;

determining an air/fuel ratio feedback complementing factor which is changed over between a constantly increasing mode which continues as long as the air/fuel ratio is on the lean side of the stoichiometric value and a constantly decreasing mode which continues as long as the air/fuel ratio is on the rich side of the stoichiometric value;

determining a learning control factor;

multiplying said basic fuel injection time duration by said air/fuel ratio feedback complementing factor and further modifying said basic fuel injection time duration by said learning control factor so as to change in the same direction as said learning control factor changes to provide an actual fuel injection time duration, wherein said learning control factor is obtained by initially setting said learning control factor at a predetermined initial value, calculating a mean value of each two successive end values of said air/fuel ratio feedback complementing factor in the constantly increasing and constantly decreasing modes thereof, increasing the current value of said learning control factor by a predetermined increment each time when said mean value is calculated to be larger than a predetermined first limit value, decreasing the current value of said learning control factor by a predetermined decrement each time when said mean value is calculated to be smaller than a predetermined second limit value which is smaller than said first limit value, maintaining the current value of said learning control factor each time when said mean value is calculated to be between said first and second limit values, and further increasing the current value of said learning control factor by a predetermined increment stepwise when and only when said air/fuel ratio feedback complementing factor is larger than a predetermined relatively large limit value; and controlling the air/fuel ratio in accordance with said actual fuel injection time duration.

2. A method as in claim 1 wherein said further increasing of said learning control factor is performed only when the air/fuel ratio is on the lean side and said learning control factor is being decreased.

3. A method of learning control for air/fuel ratio of an internal combustion engine operated with fuel injection to maintain the air/fuel ratio at the stoichiometric value, comprising the steps of:

determining a basic fuel injection time duration according to engine load and engine revolution speed;

determining an air/fuel ratio feedback complementing factor which is changed over between a constantly increasing mode which continues as long as the air/fuel ratio is on the lean side of the stoichiometric value and a constantly decreasing mode which continues as long as the air/fuel ratio is on the rich side of the stoichiometric value;

determining a learning control factor;

multiplying said basic fuel injection time duration by said air/fuel ratio feedback complementing factor and further modifying said basic fuel injection time duration by said learning control factor so as to change in the same direction as said learning control factor changes to provide an actual fuel injection time duration, wherein said learning control factor is obtained by initially setting said learning control factor at a predetermined initial value, calculating a mean value of each two successive end values of said air/fuel ratio feedback complementing factor in the constantly increasing and constantly decreasing modes thereof, increasing the current value of said learning control factor by a predetermined increment each time when said mean value is calculated to be larger than a predetermined first limit value, decreasing the current value of said learning control factor by a predetermined decrement each time when said mean value is calculated to be smaller than a predetermined second limit value which is smaller than said first limit value, maintaining the current value of said learning control factor each time when said mean value is calculated to be between said first and second limit values, and further decreasing the current value of said learning control factor by a predetermined decrement stepwise when and only when said air/fuel ratio feedback complementing factor is smaller than a predetermined relatively small limit value; and controlling the air/fuel ratio in accordance with said actual fuel injection time duration.

4. A method as according to claim 3 wherein said further decreasing of said learning control factor is performed only when the air/fuel ratio is on the rich side and said learning control factor is being increased.

5. A method of learning control for air/fuel ratio of an internal combustion engine operated with fuel injection to maintain the air/fuel ratio at the stoichiometric value, comprising the steps of:

determining a basic fuel injection time duration according to engine load and engine revolution speed;

determining an air/fuel ratio feedback complementing factor which is changed over between a constantly increasing mode which continues as long as the air/fuel ratio is on the lean side of the stoichiometric value and a constantly decreasing mode which continues as long as the air/fuel ratio is on the rich side of the stoichiometric value;

determining a learning control factor;

multiplying said basic fuel injection time duration by said air/fuel ratio feedback complementing factor and further modifying said basic fuel injection time by said learning control factor so as to change in the same direction as said learning control factor changes to provide an actual fuel injection time duration, wherein said learning control factor is obtained by initially setting said learning control factor at a predetermined initial value, calculating a mean value of each two successive end values of said air/fuel ratio feedback complementing factor in the constantly increasing and constantly decreasing modes thereof, increasing the current value of said learning control factor by a predetermined increment each time when said mean value is calculated to be larger than a predetermined first limit value, decreasing the current value of said learning control factor by a predetermined decrement each time when said mean value is calculated to be smaller than a predetermined second limit value which is smaller than said first limit value, maintaining the current value of said learning control factor each time when said mean value is calculated to be between said first and second limit values, further increasing the current value of said learning control factor by a predetermined increment stepwise when and only when said air/fuel ratio feedback complementing factor is larger than a predetermined relatively large limit value, and further decreasing the current value of said learning control factor by a predetermined decrement stepwise when and only when said air/fuel ratio feedback complementing factor is smaller than a predetermined relatively small limit value; and controlling the air/fuel ratio in accordance with said actual fuel injection time duration.

6. A method as in claim 5 wherein said further increasing of said learning control factor is performed only when the air/fuel ratio is on the lean side and said learning control factor is being decreased and said further decreasing of said learning control factor is performed only when the air/fuel ratio is on the rich side and said learning control factor is being increased.

7. Apparatus performing learning control for air/fuel ratio of an internal combustion engine operated with fuel injection to maintain the air/fuel ratio at the stoichiometric value comprising:

means for determining an indication of engine load;

means for determining engine revolution speed;

means for generating an indication of whether the air/fuel ratio is on the lean side or the rich side of the stoichiometric value;

processing means for: (1) determining a basic fuel injection time duration according to engine load and engine revolution speed, (2) determining an air/fuel ratio feedback complementing factor which is changed over between a constantly increasing mode which continues as long as the air/fuel ratio is on the lean side of the stoichiometric value and a constantly decreasing mode which continues as long as the air/fuel ratio is on the rich side of the stoichiometric value, (3) determining a learning control factor, and (4) multiplying said basic fuel injection time duration by said air/fuel ratio feedback complementing factor and further modifying said basic fuel injection time duration by said learning control factor so as to change in the same direction as said learning control factor changes to provide an actual fuel injection time duration, said learning control factor being obtained by: (a) initially setting said learning control factor at a predetermined initial value; (b) calculating a mean value of each two successive end values of said air/fuel ratio feedback complementing factor in the constantly increasing and constantly decreasing modes thereof, (c) increasing the current value of said learning control factor by a predetermined increment each time when said mean value is calculated to be larger than a predetermined first limit value, (d) decreasing the current value of said learning control factor by a predetermined decrement each time when said mean value is calculated to be smaller than a predetermined second limit value which is smaller than said first limit value, e) maintaining the current value of said learning control factor each time when said mean value is calculated to be between said first and second limit values, and f) further increasing the current value of said learning control factor by a predetermined increment stepwise when and only when said air/fuel ratio feedback complementing factor is larger than a predetermined relatively large limit value; and means for controlling the air/fuel ratio in accordance with said actual fuel injection time duration.

8. Apparatus as in claim 7 wherein said processing means performs said further increasing of said learning control factor only when the air/fuel ratio is on the lean side and said learning factor is being decreased.

9. Apparatus performing learning control for air/fuel ratio of an internal combustion engine operated with fuel injection to maintain the air/fuel ratio at the stoichiometric value, comprising:

means for determining a value related to engine load;

means for determining a value related to engine revolution speed;

means for generating an indication as to whether the air/fuel ratio is on the lean side or the rich side of the stoichiometric value;

processing means for: (1) determining a basic fuel injection time duration according to engine load and engine revolution speed, (2) determining an air/fuel ratio feedback complementing factor which is changed over between a constantly increasing mode which continues as long as the air/fuel ratio is on the lean side of the stoichiometric value and a constantly decreasing mode which continues as long as the air/fuel ratio is on the rich side of the stoichiometric value, (3) determining a learning control factor, and (4) generating an actual fuel injection time duration by multiplying said basic fuel injection time duration by said air/fuel ratio feedback complementing factor and further modifying said basic fuel injection time duration by said learning control factor so as to change in the same direction as said learning control factor changes, said learning control factor being obtained by: (a) initially setting said learning control factor at a predetermined initial value, (b) calculating a mean value of each two successive end values of said air/fuel ratio feedback complementing factor in the constantly increasing and constantly decreasing modes thereof, (c) increasing the current value of said learning control factor by a predetermined increment each time when said mean value is calculated to be larger than a predetermined first limit value, (d) decreasing the current value of said learning control factor by a predetermined decrement each time when said mean value is calculated to be smaller than a predetermined second limit value which is smaller than said first limit value, (e) maintaining the current value of said learning control factor each time when said mean value is calculated to be between said first and second limit values, and (f) further decreasing the current value of said learning control factor by a predetermined decrement stepwise when and only when said air/fuel ratio feedback complementing factor is smaller than a predetermined relatively small limit value; and means for controlling the air/fuel ratio in accordance with said actual fuel injection time duration.

10. Apparatus as in claim 9 wherein said processing means performs said further decreasing of said learning control factor only when the air/fuel ratio is on the rich side and said learning control factor is being increased.

11. Apparatus as in claim 9 wherein said processing means also further increases the current value of said learning control factor by a predetermined increment stepwise when and only when said air/fuel ratio feedback complementing factor is larger than a predetermined relatively large limit value.

12. Apparatus as in claim 11 wherein said processing means performs said further increasing only when the air/fuel ratio is on the lean side and said learning control factor is decreased, said processing means performing said further decreasing of said learning control factor only when the air/fuel ratio is on the rich side and said learning control factor is being increased.

* * * * *